US007296549B1

(12) United States Patent
Sailer et al.

(10) Patent No.: US 7,296,549 B1
(45) Date of Patent: Nov. 20, 2007

(54) HYDRAULIC VALVE LASH ADJUSTERS

(75) Inventors: Peter Sailer, Erlangen (DE); Oliver Schnell, Veitsbronn (DE)

(73) Assignee: Schaeffler KG, Herzogenaurach (DE)

( * ) Notice: Subject to any disclaimer, the term of this patent is extended or adjusted under 35 U.S.C. 154(b) by 0 days.

(21) Appl. No.: 11/503,567

(22) Filed: Aug. 11, 2006

(51) Int. Cl.
*F01L 1/14* (2006.01)

(52) U.S. Cl. ..... 123/90.52; 123/90.45; 123/90.48

(58) Field of Classification Search ..... 123/90.48, 123/90.52, 90.55, 90.39, 90.44, 90.45, 90.46
See application file for complete search history.

(56) References Cited

U.S. PATENT DOCUMENTS 7,093,575 B2 * 8/2006 Bauman et al. ..... 123/90.45

FOREIGN PATENT DOCUMENTS

DE 42 01 618 A 1 1/1992
DE 196 30 443 A 1 7/1996
DE 197 10 577 A 1 3/1997
DE 198 44 202 A 1 9/1998

* cited by examiner

*Primary Examiner*—Ching Chang
(74) *Attorney, Agent, or Firm*—Charles A. Muserlian

(57) ABSTRACT

In hydraulic valve last adjusters for the timing gear of an internal combustion engine comprising cylinder valve lift reversal or deactivation, said adjusters being loaded by cams of one or more camshafts while being made as a combination of switchable lash adjusters (22) and (non-switchable) standard lash adjusters, said adjusters further being configured as reverse-spring adjusters or free-ball adjusters, each adjuster comprising a control valve (32) whose closing body (41) is in the opening position during a base circle phase of the associated cam, according to the invention, the stroke of the closing body (41) of a switchable lash adjuster (22) is smaller in each case than the stroke of the closing body of a standard lash adjuster. This enables the idle strokes of the two different types of last adjusters to be adapted to each other.

4 Claims, 2 Drawing Sheets

HYDRAULIC VALVE LASH ADJUSTERS

FIELD OF THE INVENTION

The invention concerns hydraulic valve lash adjusters for a timing gear of an internal combustion engine comprising cylinder valve lift reversal or deactivation, said adjusters being loaded by cams of one or more camshafts while being made as a combination of switchable lash adjusters and (non-switchable) standard lash adjusters, said adjusters further being configured as reverse-spring adjusters or free-ball adjusters, each adjuster comprising a control valve whose closing body is in an opening position during a base circle phase of an associated cam.

BACKGROUND OF THE INVENTION

Hydraulic valve lash adjusters serve to adjust the lash that is formed between the transmission elements during the transmission of the cam lift by a camshaft to a gas exchange valve of the internal combustion engine due to wear or thermal expansion. Lash adjusters are used with the aim of achieving a low-noise and low-wear operation of the valve train and the greatest possible compliance between the cam lobe and the lift of the respective gas exchange valve.

Prior art last adjusters of the pre-cited type possess a control valve in the form of a one-way valve that comprises a closing body, for example, a ball. The closing body may be loaded by a spring of the control valve. In the case of a switchable lash adjuster with a control valve disclosed in the document DE 102 04 673 A1, the closing body is loaded by a control valve spring in closing direction. As a result, the control valve is mostly closed and an idle stroke of the lash adjuster does not take place. However, with this configuration, the danger of a pumping-up of the lash adjuster exists.

This drawback is avoided with control valves whose control valve springs load the closing body in the opening direction, or control valves that have no spring at all. Due to the reversed arrangement of the control valve spring, lash adjusters with such a control valve are called reverse-spring adjusters, or if the spring is omitted, free-ball adjusters. These have a positive effect on the thermodynamics, the pollutant emission and the mechanical loading of the internal combustion engine and are therefore finding increasing use.

In the aforesaid prior art structure, the control valve is closed most of the time in the base circle phase of the cam due to the spring force of the control valve spring. In contrast, in a reverse-spring adjuster, the control valve is kept open in this phase due to the force of the control valve spring, or, in the case of a free-ball adjuster, closing is not forced. Because such an adjuster can only be closed by the hydrodynamic and hydrostatic forces of the lubricating oil stream that starts to flow from the high pressure chamber to the low pressure chamber at the beginning of the cam lobe phase, this adjuster always executes an idle stroke before the valve lift of the gas exchange valve starts. The magnitude of the idle strokes at every engine speed depends on the duration of the closing time of the control valve and this, in turn, depends on the viscosity/density of the lubricating oil that is used here, as is generally known, as a hydraulic medium.

For closing the control valve of a reverse-spring adjuster or a free-ball adjuster, a so-called critical lubricating oil speed is required. This depends on the viscosity of the lubricating oil and thus on the temperature of the lubricating oil. With a high lubricating oil viscosity/density, i.e., at a low lubricating oil temperature, the critical lubricating oil speed is lower and is therefore reached faster than with a lower lubricating oil viscosity, that is to say, higher lubricating oil temperature. At cold start, this leads to a shorter closing time of the control valve and, consequently, to a smaller idle stroke than when the engine is at running temperature. But a smaller idle stroke means a larger valve overlap. This results in a stronger internal recirculation of exhaust gas that causes an erratic low-speed idling of the engine. This can naturally be ameliorated by increasing the idling speed but would be at the expense of pollutant emission and fuel consumption. Non-switchable reverse-spring adjusters are known, for instance, from the documents EP 1 298 287 A2, JP 61-185607 and U.S. Pat. No. 4,054,109. All these show lash adjusters in which the control valve possesses a closing body in the form of a ball. In these prior art examples, the closing body is guided in bores.

As already mentioned, in the case of reverse-spring adjusters and free-ball adjusters, the closing body of the control valve is the opening position during the base circle of the cam. For closing the control valve, a volume stream that causes a differential pressure on the closing body must flow past the closing body. Due to this pressure difference, the closing body closes the control valve. The timing gears of engines with cylinder valve lift reversal or deactivation comprise both switchable and non-switchable lash adjusters. For a better distinction over switchable lash adjusters, the non-switchable lash adjusters are designated as standard lash adjusters in the present context. In order to provide receptions of the same size for all the lash adjusters in the engine housing, due to the different structures of standard lash adjusters and switchable lash adjusters, different dimensions have to be implemented in their piston and control valve regions. Thus, the piston that is guided for axial displacement in the adjuster housing often has a smaller diameter in switchable lash adjusters than in standard lash adjusters. In the case of reverse-spring adjusters, this can lead to different modes of operation, i.e., to variable idle strokes with the corresponding detrimental effects on the thermodynamics of the engine.

In the mode of operation of reverse-spring adjusters and free-ball adjusters, a desired idle stroke of the adjuster housing, i.e., an axial displacement of the housing relative to the non-displaced piston guided therein, is obtained during the idle stroke. Variations of this idle stroke in a single adjuster should be as small as possible. Further, variations of the idle strokes of all the reverse-spring adjusters and free-ball adjusters arranged in a single engine should likewise be as small as possible. If reverse-spring adjusters or free-ball adjusters with different adjuster diameters, i.e. piston diameters, are installed in a single engine, the idle strokes of these adjusters must b matched to one another. If not, detrimental effects on the mode of functioning and on the idle and smooth running of the engine are the result.

OBJECTS OF THE INVENTION

It is an object of the invention to enable the matching of the idle strokes of reverse-spring or free-ball adjusters with different adjuster or piston diameter installed in a single engine. This means that if the timing gear of an engine comprises both standard lash adjusters as well as switchable lash adjusters, the idle strokes of these different adjusters should be adapted to one another.

This and other objects and advantages of the invention will become obvious from the following detailed description.

SUMMARY OF THE INVENTION

According to a first proposition of the invention, the above objects are achieved by the fact that the stroke of the closing body of a switchable lash adjuster is smaller in each case than the stroke of the closing body of a standard lash adjuster. Therefore, the structural dimensions of the adjuster components in the region of the control valve are chosen such that the aforesaid difference in the strokes of the two different types of lash adjusters is obtained.

In place of different strokes of the closing bodies, it is possible according to further propositions of the invention, to achieve the above objects by designing the spring forces of the control valve springs, the flow cross-sections of the control valves or the leak gaps between the housings and the pistons of the lash adjusters differently.

The invention will now be described with reference to the appended drawing.

DETAILED DESCRIPTION OF THE DRAWING

Figure 1:
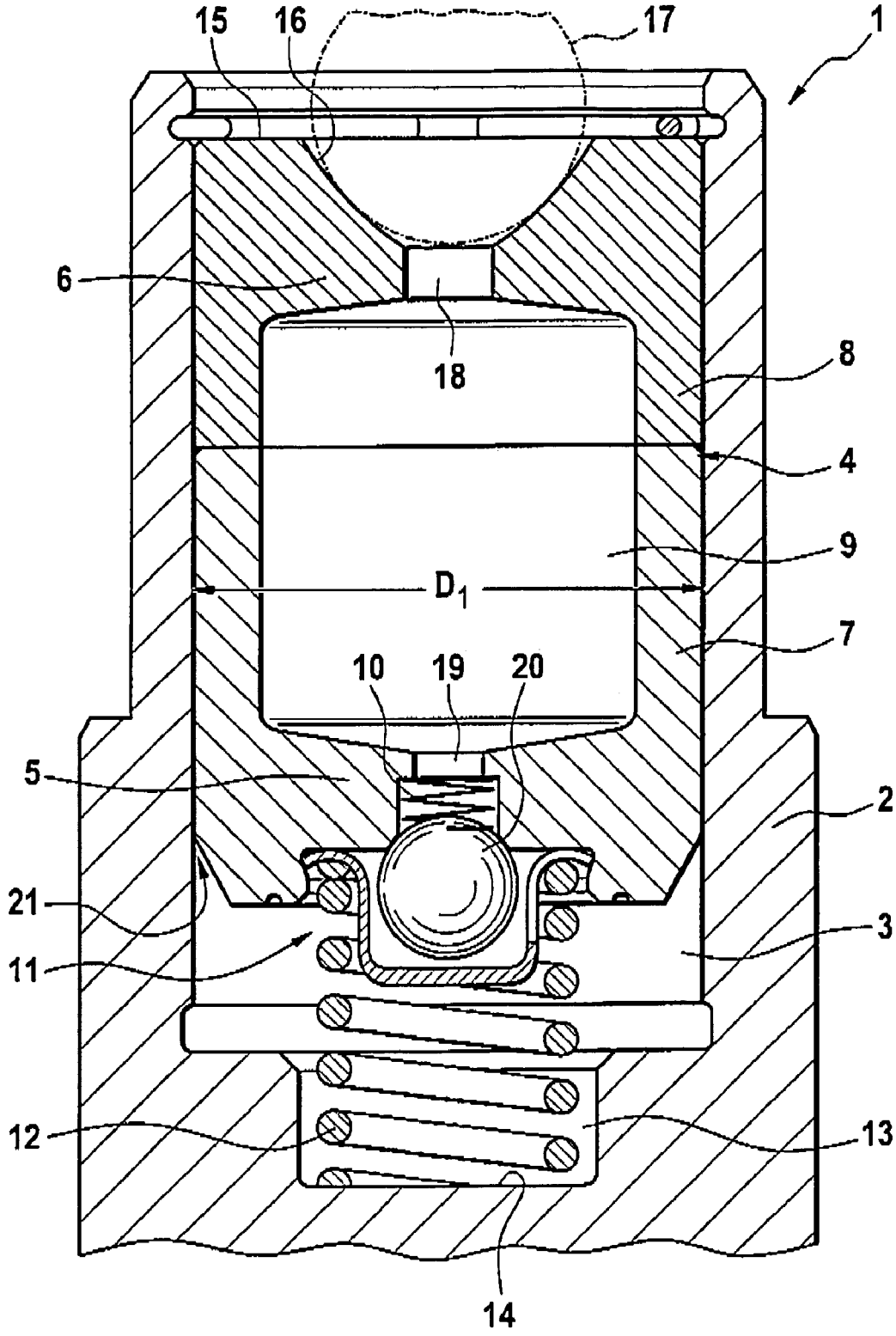
FIG. 1 shows a non-switchable reverse-spring adjuster in a longitudinal section.

The valve lash adjuster illustrated in FIG. 1 is configured as a non-switchable hydraulic tappet in the form of a reverse-spring adjuster. This will be designated in the following as a standard lash adjuster 1 and comprises a rotationally symmetric housing 2 on whose lower end is arranged a roller, not represented, that is in contact with a cam of a camshaft. The housing 2 possesses a stepped blind hole that forms a high pressure chamber 3. A hollow cylindrical piston 4 is guided in this chamber with a sealing clearance. The piston 4 comprises a lower piston bottom 5 and an upper piston bottom 6 and is divided into an upper piston part 7 and a lower piston part 8. The high pressure chamber 3 is situated under the lower piston bottom 5. A low pressure chamber 9 that is formed by the inner space of the piston 4 and serves as an oil reservoir is situated above the lower piston bottom 5.

The high pressure chamber 3 is connected to the low pressure chamber 9 through a central axial bore 19 that is arranged in the lower piston bottom 5. This axial bore 19 is part of a control valve 11 comprising a control valve spring 10. The control valve 11 extends into the high pressure chamber 3 to beneath the lower piston bottom 5. A compression spring 12 supported in a central recess 13 on the bottom 14 of the high pressure chamber 3 loads the piston 4 and, thus also, the valve train with its pressure force. The upper piston bottom 6 comprises on its outer surface 15, a central conical depression 16 for guiding, for example, the spherical end 17 of a tappet pushrod, not represented. A further central axial bore 18 that is situated in the upper piston bottom 6 establishes the connection of the low pressure chamber 9 to the lubricating oil supply of the valve train. The closing body 20 of this lash adjuster 1 is a ball. The outer cylindrical surface of the piston 4 and the inner cylindrical surface of the housing 2 define a leak gap 21 that, as viewed in a cross-section of the adjuster, has an annular configuration. The piston 4 may have an outer diameter $D_1$ of, for instance, 15 mm.

Figure 2:
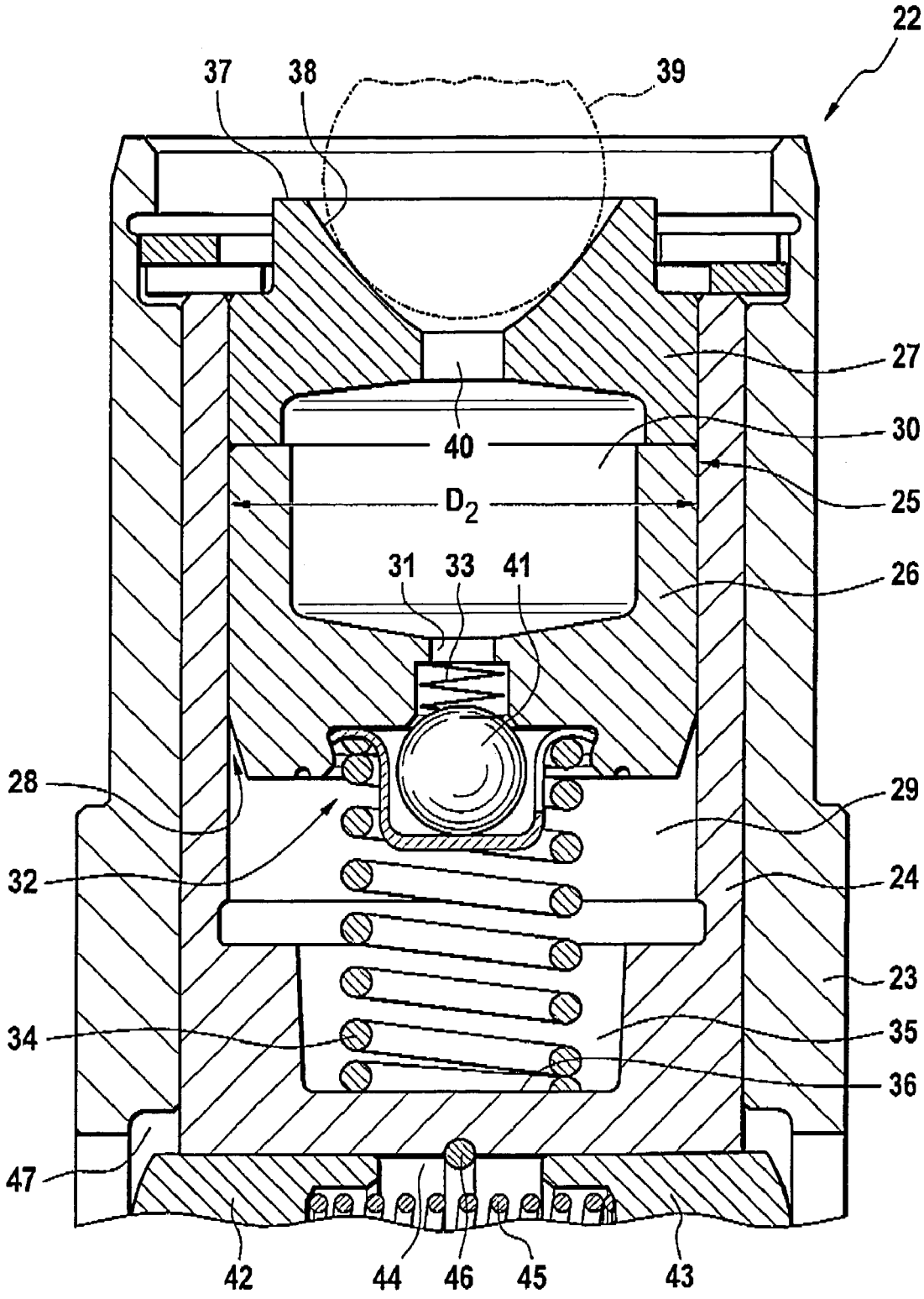
FIG. 2 shows a switchable reverse-spring adjuster in a longitudinal section.

FIG. 2 shows a switchable lash adjuster 22 that, similar to the valve lash adjuster of FIG. 1, is configured as a hydraulic reverse-spring lash adjuster and is in contact with a cam of a camshaft. In this lash adjuster, an inner housing 24 is additionally arranged for axial displacement in an outer housing 23. A piston 25 is arranged for axial displacement within the inner housing 24. The piston 25 has a divided configuration and comprises a lower piston part 26 and an upper piston part 27. Together with the surrounding inner housing 24, the piston 25 defines a leak gap 28 that, as viewed in a cross-section of the adjuster, has an annular configuration.

Many parts of the switchable lash adjuster 22 have a similar configuration to corresponding parts of the standard lash adjuster of FIG. 1, viz., a stepped blind hole in the inner housing 24 that forms a high pressure chamber 29, a piston 25 enclosing a low pressure chamber 30, a central axial bore 31 as part of a control valve 32 having a control valve spring 33, a compression spring 34 that is supported in a central recess 35 on the bottom 36 of the high pressure chamber 29 and loads in piston 25, and also an outer surface 27 of the upper piston part 27 having a central conical depression 38 for guiding the spherical end 39 of a tappet pushrod. In this switchable lash adjuster 22, too, a further central axial bore 40 that is situated in the upper piston part 27 establishes the connection of the low pressure chamber 30 to the lubricating oil supply of the valve train, and the closing body 41 of the lash adjuster 22 is a ball. The piston 25 may have an outer diameter $D_2$ of, for instance, 12.7 mm.

To enable a valve deactivation or a valve activation, the lash adjuster 22 comprises a coupling means for the outer housing 23 and the inner housing 24 in the form of two pistons 42 and 43 that are arranged for sliding in a radial bore 44 of the inner housing 24 while being loaded by a compression spring 45. A stop ring 46 limits the radially inwards directed movement of the pistons 42 and 43 in the housing 24 that is caused by the pressure of the hydraulic medium. As a result of the action of the compression spring 45, the pistons 42 and 43 can execute an outwards directed movement and penetrate into an annular recess 47 of the outer housing 23 when this recess 47 registers with the radial bore 44 of the inner housing 24. In this way, the outer housing 23 and the inner housing 24 are locked to each other.

The invention claimed is:

1. Hydraulic valve lash adjusters for a timing gear of an internal combustion engine comprising cylinder valve lift reversal or deactivation, said adjusters being loaded by cams of one or more camshafts while being made as a combination of switchable lash adjusters and (non-switchable) standard lash adjusters, said adjusters further being configured as reverse-spring adjusters or free-ball adjusters, each adjuster comprising a control valve whose closing body is in an opening position during a base circle phase of an associated cam, wherein a stroke of the closing body of a switchable lash adjuster is smaller in each case than a stroke of the closing body of a standard lash adjuster.

2. Hydraulic valve lash adjusters for a timing gear of an internal combustion engine comprising cylinder valve lift reversal or deactivation, said adjusters being loaded by cams of one or more camshafts while being made as a combination of switchable lash adjusters and (non-switchable) standard lash adjusters, said adjusters further being configured as reverse-spring adjusters or free-ball adjusters, each adjuster comprising a control valve whose closing body is in an opening position during a base circle phase of an associated cam, wherein, when reverse-spring adjusters are used, that is, adjusters whose closing bodies are loaded by a control valve spring, a spring force of the control valve spring of a switchable lash adjuster is smaller than a spring force of the control valve spring of a standard lash adjuster.

3. Hydraulic valve lash adjusters for a timing gear of an internal combustion engine comprising cylinder valve lift reversal or deactivation, said adjusters being loaded by cams of one or more camshafts while being made as a combination of switchable lash adjusters and (non-switchable) standard lash adjusters, said adjusters further being configured as reverse-spring adjusters or free-ball adjusters, each adjuster comprising a control valve whose closing body is in an opening position during a base circle phase of an associated cam, wherein a flow cross-section of an opened control valve of a switchable lash adjuster is larger than a flow cross-section of an opened control valve of a standard lash adjuster.

4. Hydraulic valve lash adjusters for a timing gear of an internal combustion engine comprising cylinder valve lift reversal or deactivation, said adjusters being loaded by cams of one or more camshafts while being made as a combination of switchable lash adjusters and (non-switchable) standard lash adjusters, said adjusters further being configured as reverse-spring adjusters or free-ball adjusters, each adjuster comprising a control valve whose closing body is in an opening position during a base circle phase of an associated cam, so that a high pressure chamber that is formed by a cylindrical housing is connected to a low pressure chamber that is formed by a piston that is axially displaceable in the cylindrical housing, the piston and the cylindrical housing defining a leak gap, wherein the leak gap of a switchable lash adjuster is larger than the leak gap of a standard lash adjuster.

* * * * *